US007162847B2

(12) United States Patent
Gigiakos

(10) Patent No.: US 7,162,847 B2
(45) Date of Patent: Jan. 16, 2007

(54) APPARATUS AND METHOD FOR FABRICATING FOAM WALL PANELS

(76) Inventor: Marko Gigiakos, 330 S. Ocean Blvd., #624C, Highland Beach, FL (US) 33487

( * ) Notice: Subject to any disclaimer, the term of this patent is extended or adjusted under 35 U.S.C. 154(b) by 0 days.

(21) Appl. No.: 10/321,198

(22) Filed: Dec. 16, 2002

(65) Prior Publication Data

US 2004/0111997 A1 Jun. 17, 2004

(51) Int. Cl.
*E04B 2/00* (2006.01)
*E04C 3/30* (2006.01)

(52) U.S. Cl. ..... 52/731.7; 52/731.9; 52/582.1; 52/762

(58) Field of Classification Search ..... 52/582.1, 52/481.1, 762, 764, 763, 780, 781, 731.5, 52/731.7, 731.9, 733.2, 36.1, 481.2, 731.8; 403/295, 294, 292, 340; 160/239
See application file for complete search history.

(56) References Cited

U.S. PATENT DOCUMENTS

| | | | | | |
|---|---|---|---|---|---|
| 114,138 | A | * | 4/1871 | Hersey | 403/340 |
| 2,134,674 | A | * | 10/1938 | Sherman et al. | 52/376 |
| 3,767,232 | A | * | 10/1973 | Smith | 285/150.1 |
| 3,841,047 | A | * | 10/1974 | Zinn | 52/733.2 |
| 3,841,051 | A | * | 10/1974 | Zinn | 52/747.1 |
| 3,922,828 | A | * | 12/1975 | Patton | 52/368 |
| 4,661,392 | A | * | 4/1987 | Kapstad | 428/182 |
| 4,907,383 | A | | 3/1990 | Winter, IV | |
| 5,079,884 | A | * | 1/1992 | Menchetti | 52/241 |
| 5,086,599 | A | | 2/1992 | Meyerson | |
| 5,293,728 | A | | 3/1994 | Christopher et al. | |
| 5,381,638 | A | | 1/1995 | Anderson | |
| 5,448,865 | A | | 9/1995 | Palmersten | |
| 5,464,302 | A | * | 11/1995 | Menchetti | 403/335 |
| 5,483,777 | A | * | 1/1996 | Menchetti et al. | 52/481.1 |
| 5,485,706 | A | * | 1/1996 | Menchetti | 52/731.5 |
| 5,515,659 | A | * | 5/1996 | MacDonald et al. | 52/474 |
| 5,613,338 | A | | 3/1997 | Esposito | |
| 5,664,386 | A | * | 9/1997 | Palmersten | 52/588.1 |
| 5,673,524 | A | | 10/1997 | Gailey | |
| 5,822,940 | A | * | 10/1998 | Carlin et al. | 52/479 |
| 6,006,480 | A | * | 12/1999 | Rook | 52/309.12 |
| 6,006,481 | A | * | 12/1999 | Jacobs | 52/309.9 |
| 6,122,879 | A | | 9/2000 | Montes | |
| 6,167,624 | B1 | * | 1/2001 | Lanahan et al. | 29/897.32 |
| 6,216,410 | B1 | | 4/2001 | Haberman | |
| 6,247,285 | B1 | | 6/2001 | Moebus | |
| 6,688,066 | B1 | * | 2/2004 | Cottier et al. | 52/481.1 |
| 6,711,867 | B1 | * | 3/2004 | Smith | 52/696 |

(Continued)

*Primary Examiner*—Peter M. Cuomo
*Assistant Examiner*—Sarah B. McPartlin
(74) *Attorney, Agent, or Firm*—John C. Smith

(57) ABSTRACT

A foam wall panel system with a unique Z-shaped wall panel connection device. The Z-shape of the wall panel connection device provides cavities on each side which accept the angled edges of foam wall panels that fit within the cavities. Adjacent foam cores having angled edges are secured into the cavities on opposite sides of Z-shaped wall panel connection devices to form a continuous foam wall. The Z-shaped wall panel connection device can be fabricated from a single sheet of material, or other suitable materials, and can replace metal wall studs. The folded corner edges of the Z-shaped wall panel connection device, and the edges of the foam cores, are rounded to avoid damage to the foam wall panel during the installation process.

9 Claims, 11 Drawing Sheets

U.S. PATENT DOCUMENTS 6,729,094 B1 * 5/2004 Spencer et al. ..... 52/414
6,742,310 B1 * 6/2004 Weeks ..... 52/92.2
2002/0046521 A1 * 4/2002 Steinacker ..... 52/274
2004/0068948 A1 * 4/2004 Wrass ..... 52/309.7

* cited by examiner

APPARATUS AND METHOD FOR FABRICATING FOAM WALL PANELS

BACKGROUND OF THE INVENTION

1. Technical Field

The present invention relates to a foam wall construction system. In particular, it relates to a simplified metal stud for framing foam wall panels, which has opposing cavities on each side to accept the edge of a foam wall panel. In addition, it relates to a method of connecting adjacent foam wall panels with the simplified metal stud, and for providing optional wiring channels within the foam wall panels.

2. Background

The materials and techniques used in the construction of walls, both for interior and exterior use, has evolved substantially over the years. For example, interior walls were for many years constructed using "lathe and plaster" techniques. In this process, wood studs provided physical support for wooden strips which were attached to them. In turn, the layer plaster was manually installed on the wood strips. While this process provided a sturdy wall, it was very time-consuming to install and required skilled workmen to complete the installation. As a result, installing walls using this process was relatively expensive due to the time needed to install a section wall and the need for more expensive skilled workmen. Because of these drawbacks, a number of attempts have been made to reduce the time required to install a wall, and to reduce the associated costs.

Plaster walls were eventually replaced with conventional drywall panels. The system uses gypsum-type wall panels which are laminated on both sides with cardboard sheathing. A disadvantage associated with this type of wall system is that in order to provide thermal or sound insulation between rooms adjoining the wall, additional time is required and expense is incurred due to the requirement to install an insulating material between opposing drywall panels installed on the opposite sides of supporting wall studs. While improving over prior art plaster walls, the variety of components and the amount of labor required for this type of wall construction has also resulted in a relatively high installation cost.

Metal framing systems have been developed which eliminate the need for wood studs for non load bearing use. An advantage of metal studs is that they do not warp as wood may when subjected to environmental factors such as changes in humidity. As a result, metal studs allow walls to be constructed which are relatively flat in comparison to walls constructed from wood studs. Another advantage is that while wood studs are at risk of termite damage, metal studs are not. Of course, metal studs do not address the insulation issues discussed above.

More recently, prefabricated insulated wall panels have been developed based on foam core walls. The foam core walls typically are laminated structures in which the central foam core is laminated on both sides with protective layers. One or both of the protective layers may be fabricated from a material such as oriented strand board ("OSB"). This type of wall panel (which can also be used for flooring or roofing purposes, depending on how sturdy their construction is) typically comes in large panel sizes (e.g., 4 ft. by 8 ft.). They typically are heavy and require a substantial effort to install. Likewise, not all wall installations require high strength protective layers on one or more sides. It would be desirable to have a method of installing foam cores for walls which does not require heavy and unwieldy exterior sheathing.

A number of connection methods have been developed for the installation of wall panels. In particular, a variety of edge connecting devices have been developed for interlocking adjacent wall panels such that large segments of walls can be fabricated using a series of wall panels. Typically, these edge connectors are relatively complicated devices which use, tongue and groove structures, spring loaded clamps, etc. in order to secure adjacent panels together. These types of structures often contribute to component failure due to their complexity. Likewise, as the structure of these devices becomes more complicated, the cost of their fabrication also increases. It would be desirable to have a method of connecting adjacent wall panels which is less prone to failure during the installation process, and which is less expensive to manufacture due to its simplicity of design.

SUMMARY OF THE INVENTION

The present invention provides an apparatus and method for connecting foam wall panels together with a unique Z-shaped wall panel connection device. The Z-shape of the wall panel connection device provides a cavity on each side which is designed to accept the edge of a foam wall panel which is angled to fit within the cavity. Adjacent foam cores having angled edges are secured into the cavities on opposite sides of Z-shaped wall panel connection devices to form a continuous foam wall. The Z-shaped wall panel connection device can be fabricated from a single sheet of material, and can replace metal wall studs. The folded corner edges of the Z-shaped wall panel connection device, and the edges of the foam cores, are rounded to avoid damage to the foam wall panel during the installation process.

DESCRIPTION OF THE PREFERRED EMBODIMENT

Figure 1:
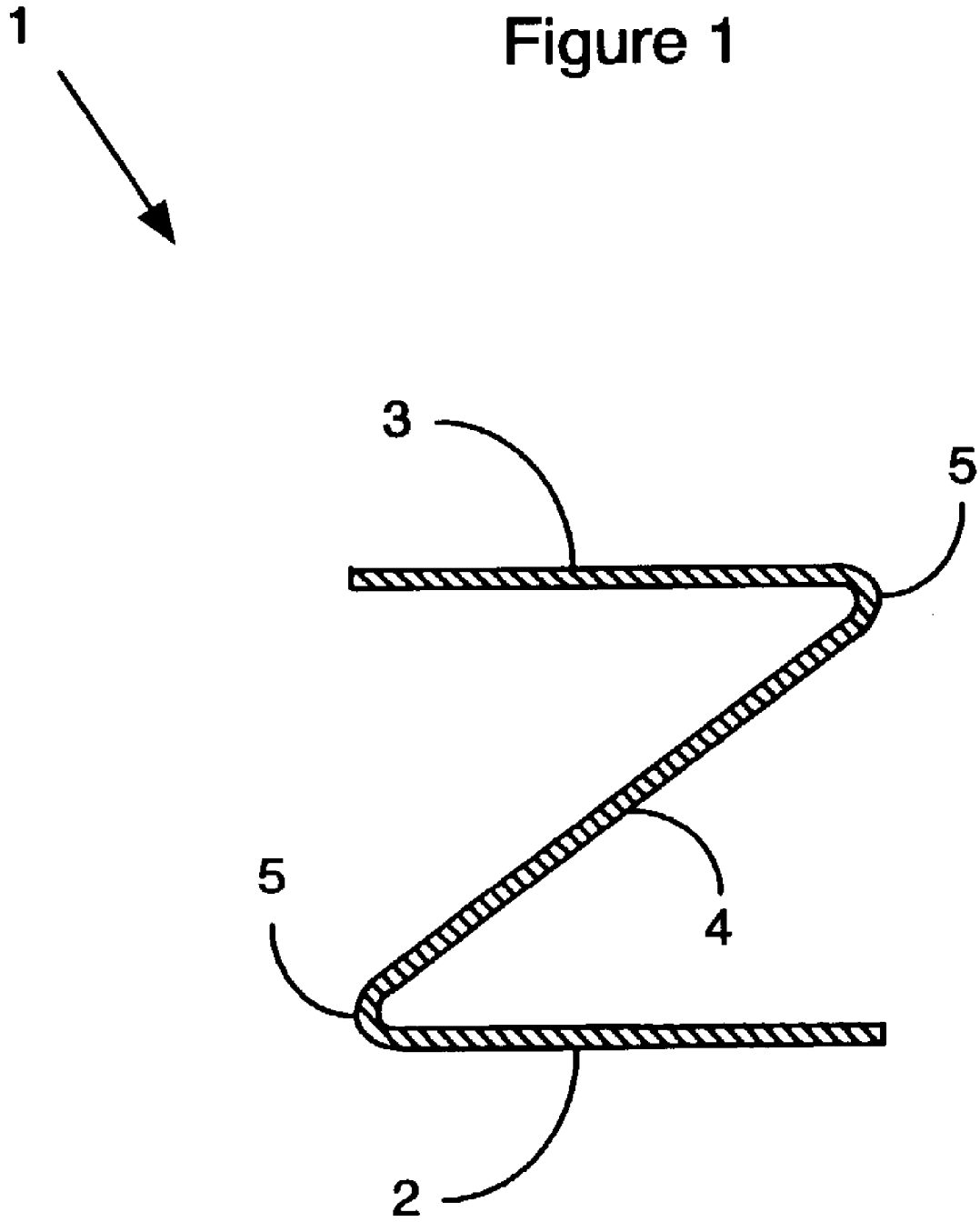
FIG. 1 is a top view of a preferred embodiment of the Z-shaped wall panel connection device.

Prior to a detailed discussion of the figures, a general overview of the system will be presented. The invention provides a method of constructing foam walls in a rapid and inexpensive manner with a minimal number of components. In particular, a foam wall can be constructed using single uniquely formed Z-shaped wall panel connection devices to secure adjacent foam panels together. The for ease of discussion, Z-shaped wall panel connection devices may be also referred to herein as a "Z-shaped stud."

The Z-shaped stud used herein has several advantages over prior art methods of connecting adjacent foam wall panels. In prior art systems, foam wall panels are connected by substantially more elaborate devices. These prior art devices typically use multiple metal components which are secured together. In addition, they tend to have elaborate methods of securing themselves to a foam wall panel. These methods include tongue and groove connections, spring loaded devices, clamps, etc. Due to their complexity, they tend to be expensive to fabricate and must be installed carefully to avoid damage.

The present invention improve substantially over these devices by using a simplified Z-shaped stud in their place. The Z-shaped stud provides a substantial advantage over prior art systems in that it can be constructed from a single sheet of material, thereby eliminating the cost and expense of fabricating multiple pieces of material and then securing them together. The Z-shaped stud also eliminates the need for complicated methods of securing the connecting device to the foam wall panel. The Z-shaped stud, whose name refers to the "Z" shape seen when viewed from the end, provides angled cavities on the each side. Each foam wall panel is also formed with its edge shaped to conform to the associated angled cavity in the Z-shaped stud.

During assembly, when a foam wall panel is placed in position, the Z-shaped stud is then mounted onto the angled side edge of the foam wall panel such that the angled to side edge snugly fits within the cavity of the Z-shaped stud. Once the Z-shaped stud is secure, the next adjacent foam wall panel is then inserted into the cavity on the other side of the Z-shaped stud. As a result, the Z-shaped stud secures two adjacent foam wall panel units together. Due to the simplicity of design, the installer does not have to carefully align components as is done in prior art systems. For example, spring loaded devices have to be carefully set in place, clamps have to be adjusted and secured, etc. The simplified assembly process provided by the Z-shaped stud results in substantial reductions in the amount of time required to install a wall, and also results in minimal waste since there are no components to break or malfunction on the Z-shaped stud. Likewise, fabrication of the Z-shaped stud as a single folded component requires minimal assembly cost.

Optionally, the foam wall panels can be further secured to the Z-shaped stud by placing a bead of adhesive or sealant on the side edge of the foam wall panel or the side edge of the Z-shaped stud which contacts the foam wall panel. By using adhesive or sealant, not only is the foam wall panel and the Z-shaped stud more securely attached to one another, they also form a more airtight seal in the wall which further improves insulation characteristics of the foam wall panel system.

Those skilled in the art will recognize that any suitable commercially available adhesive or sealant may be used to secure the foam wall panel to the Z-shaped stud. The only requirement is that the adhesive or sealant is suitable for use with the materials used to fabricate the foam wall panel and the Z-shaped stud. Likewise, the foam wall panel can be fabricated from any number of commercially available foam materials. An example of such a foam material would be expanded polystyrene foam insulation, which is commercially available from Alamo Foam, Inc., in San Antonio Tex. This material is a close sale, resilient, lightweight foam plastic. The material can be molded into a variety of shapes, including flat rectangular blocks used to form foam wall panels. Of course, numerous other types of insulating foam, fabricated from a variety of materials, are also commercially available. In addition, the Z-shaped stud itself can also be fabricated from any suitable material. For example, it can be fabricated from metal and used as a substitute for a conventional metal wall stud while at the same time securing the adjacent foam wall panels together. It can also be fabricated from other materials, such as plastics, etc., so long as it provides suitable strength and performance characteristics for its intended purpose.

While the Z-shaped stud could be formed with sharp angles at the bends in the Z-shaped stud, the preferred embodiment envisions optional rounded corners in the Z-shaped studs and optional rounded tips on the side edges of the foam wall panels. The purpose of rounding the corners of the Z-shaped studs and rounding the side edges of the foam wall panels is to reduce the possibility that pieces of foam may be chipped off of the edge of the foam wall panels which would result in debris preventing a snug fit of the Z-shaped studs.

Another optional feature of the invention is that it allows wiring to be run through one or more foam wall panels. This is accomplished by placing an aperture in the central portion of the Z-shaped stud which contacts the angled surface of the foam wall panel. This allows the channel to be cut into the foam wall panel via known hot knife techniques. If the electrical wiring placed in the channel is intended to reach a location several wall foam panels away, the channel can be cut such that it ends at the aperture in the Z-shaped stud. The adjacent foam wall panel will also have the channel cut in it. The wiring and then run through the first foam panel, through the aperture in the Z-shaped stud, and thereafter through the desire number of subsequent foam wall panels and Z-shaped studs until the selected location of the outlet is reached. Of course, multiple apertures can be provided in the Z-shaped stud to allow the installer the most convenient path for the wiring.

Those skilled in the art will recognize that the Z-shaped studs can be fabricated without any apertures. In that case, a cable installer would cut an aperture in the Z-shaped stud as needed. In the preferred embodiment, the apertures are placed in the Z-shaped studs during manufacture because they reduce the amount of time and work required to install a wall using Z-shaped studs and foam wall panels at the installation work site.

As a practical matter, it is also desirable to use a conventional channel guide to secure components of the wall to the floor of the structure. Floor channels are commonly used in metal stud wall construction to layout and define where the walls will go, and to provide a secure place for the bottom of the wall components such that they are secured to the proper location on the floor of the structure.

In summary, the invention provides an extremely simple, one-piece connection device for adjacent foam wall panels, which can also replace pre-existing metal wall studs. The device provides minimal effort to fabricate since it has a single part. In addition it provides extreme ease of installation since the foam wall panels and the Z-shaped studs are designed to snugly and cooperatively fit together without the intricate alignment problems which are associated with prior art panel connection devices. The Z-shaped stud also provides a convenient way to run cabling throughout a foam wall by allowing wiring to pass through the Z-shaped stud. Having discussed the general features and advantages of the invention, we turn now to a more detailed discussion of the figures.

Regarding FIG. 1, this figure is a top edge view of a preferred embodiment of the Z-shaped stud 1. The main components of the Z-shaped stud 1 are a first side wall 2, a second side wall 3, and a connecting wall 4. The spaces between the connecting wall 4 and the first and second side walls 2, 3 function as cavities which are designed to accept the edges of foam wall panels 7 (shown below in FIG. 2). The angle of the connecting wall 4 in regard to the first and second side walls 2, 3 is not critical so long as it provides for a cavity for accepting the edge of a foam wall panel 7, and provides sufficient surface area on both sides of the angled side edge of the foam wall panel 7 to prevent lateral movement of the foam wall panel 7 in relation to the Z-shaped stud 1.

An advantage of the Z-shaped stud 1 is that it is easy to manufacture because it can be fabricated from a single sheet of material. If fabricated from metal, it can be made from a single flat panel which is folded at corners 5. Likewise, if it is fabricated from other materials, such as plastic, polystyrene, polypropylene, PVC, etc., it can be molded or extruded into the desired shape. The exact type of material used to fabricate the Z-shaped stud 1 is not important, so long as the material is suitable to perform its intended function.

In the preferred embodiment, the corners 5 are folded such that they have a rounded shape. The rounded shape provides several advantages. For example, minor imperfections in the edge of the foam wall panel 7 will not prevent it from being properly fit into a cavity in a Z-shaped stud 1. In addition, by rounding the edges of the foam wall panels 7, it reduces the possibility that pieces of an edge of the foam wall panels 7 will be broken off and form debris which interferes with snugly fitting the foam wall panels 7 to the Z-shaped stud 1.

Figure 2:
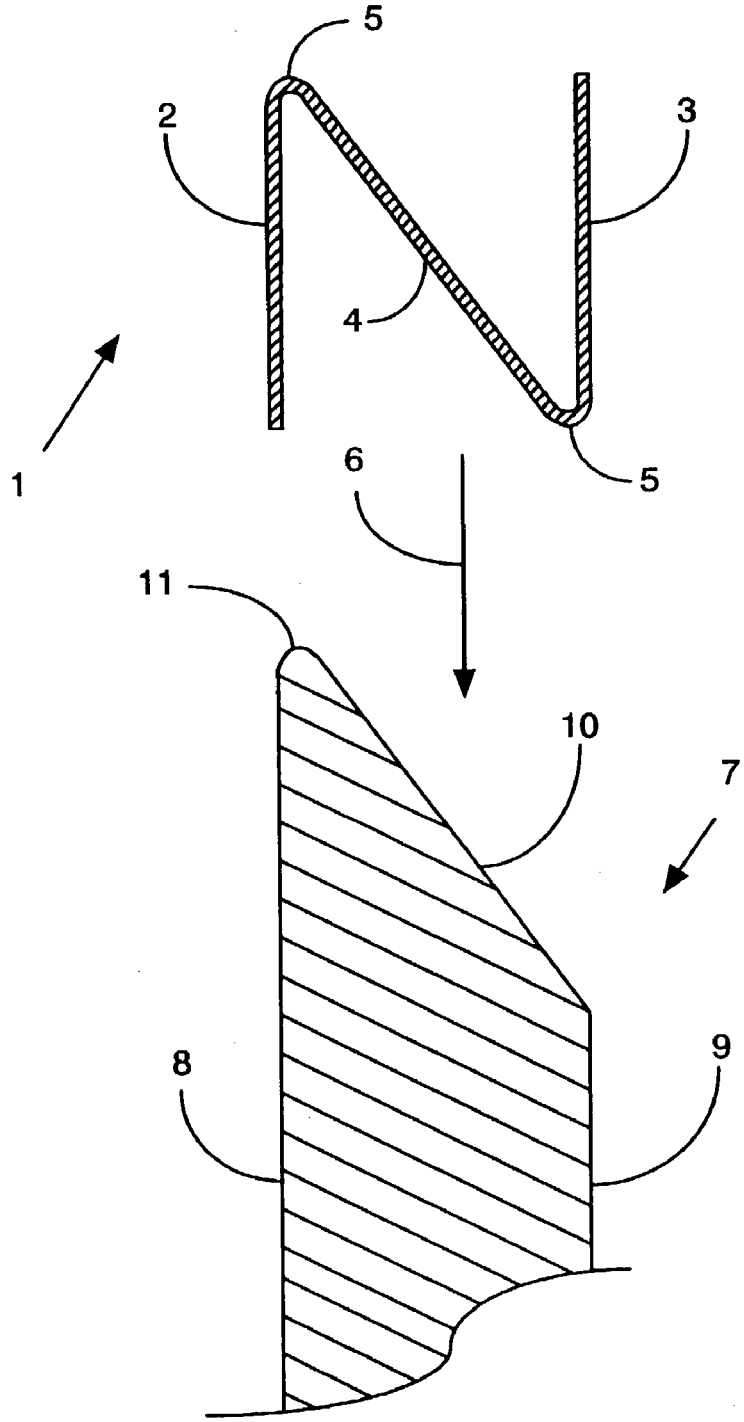
FIG. 2 is a top view of a preferred embodiment of the Z-shaped wall panel connection device being installed on a foam wall panel.

Regarding FIG. 2, this figure illustrates the joining of the Z-shaped stud 1 to a preferred embodiment of the foam wall panel 7. In this embodiment, the foam wall panel 7 has a first side 8, a second side 9, and an side edge 10. The foam wall panel 7 also has a forward edge 11. As shown in this figure, Z-shaped stud 1 is moved longitudinally in direction 6 such that the side edge 10 of foam wall panel 7 is inserted into the cavity between side wall 2 and connecting wall 4 of Z-shaped stud 1. As mentioned above, the angle between connecting wall 4 and side walls 2, 3 is not critical. However, that angle should correspond to the angle formed between side edge 10 and first side 8 in order to ensure that the Z-shaped stud 1 will form a snug and secure fit when mounted on foam wall panel 7. Likewise, the angle should be sufficient to prevent lateral movement of the foam wall panel 7 in regard to the Z-shaped stud 1.

It is preferred that forward edge 11 also be rounded to prevent interference when mounting the Z-shaped stud 1 onto the foam wall panel 7. In addition, this also reduces the likelihood of chipping during installation process which would in turn create debris that may interfere with the snug mounting of the Z-shaped stud onto the foam wall panel 7.

Figure 3:
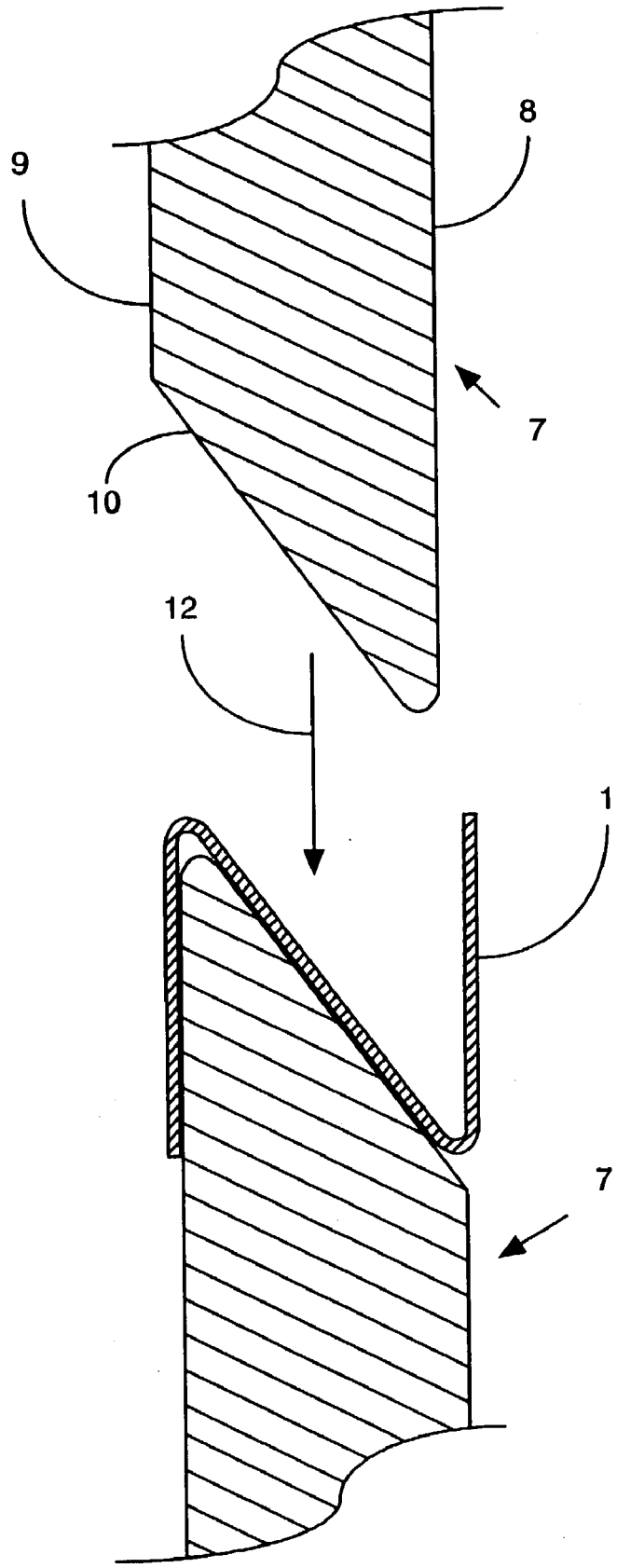
FIG. 3 is a top view of a preferred embodiment of the Z-shaped wall panel connection device installed on a first foam wall panel, and an adjacent foam wall panel being installed into the cavity on the opposite side of the Z-shaped wall panel connection device.

FIG. 3 illustrates a preferred embodiment of the next step in the wall fabrication process. Once the Z-shaped stud 1 is secured to a first foam wall panel 7, a second foam wall panel 7 can be installed along longitudinal line 12 such that its forward edge 11 is snugly inserted into the cavity of Z-shaped stud 1. As was the case discussed above, in regard to FIG. 2, the second foam wall panel 7 should be shaped such that it closely conforms to the shape of the cavity in Z-shaped stud 1. This will ensure that the snug that will result, and will prevent movement of the foam wall panel 7 in relation to the Z-shaped stud 1.

Figure 4A:
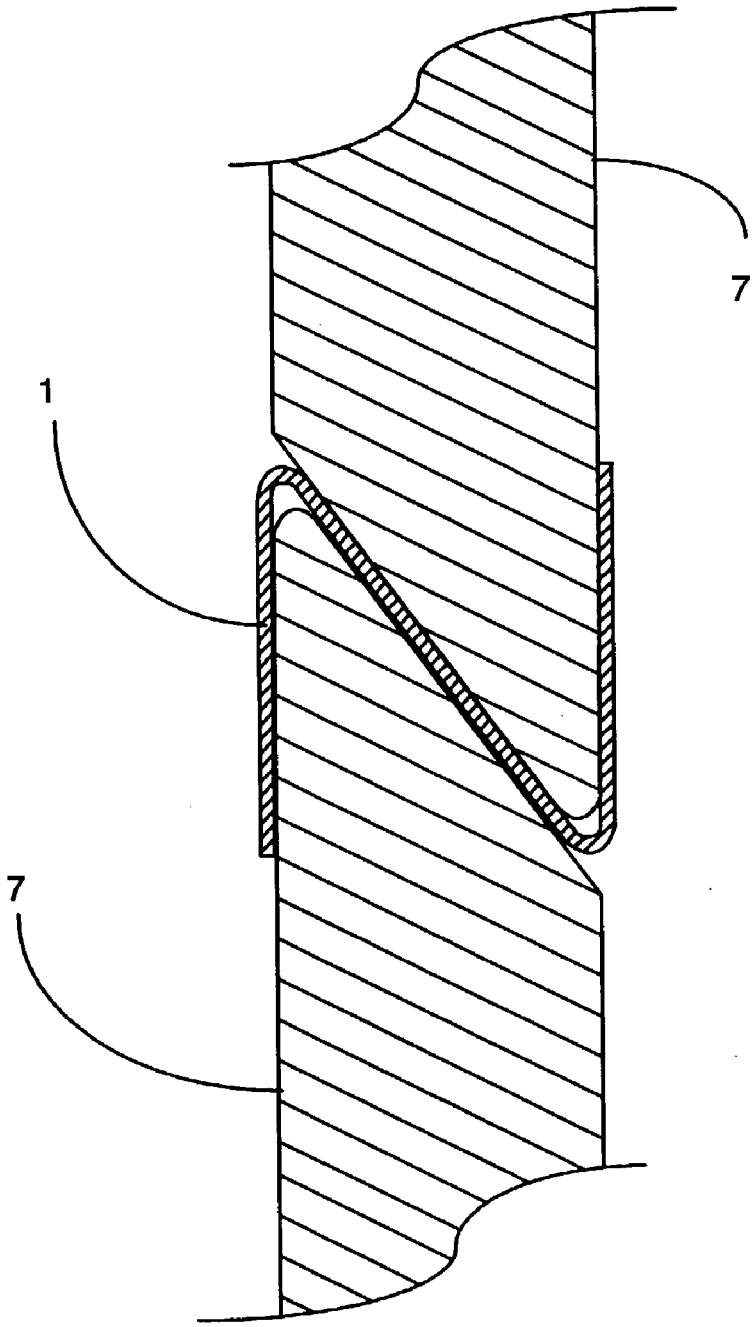
FIG. 4A is a top view of a preferred embodiment of the Z-shaped wall panel connection device securing two adjacent foam wall panels together.

FIG. 4A illustrates the resulting configuration which occurs when two adjoining foam wall panels 7 have been secured together with a Z-shaped stud 1. As can be seen, the adjoining foam wall panels 7 are closely aligned with one another to form a flat wall surface. In addition, the Z-shaped stud 1 occupies a minimal amount of space and requires no alignment to install.

Figure 4B:
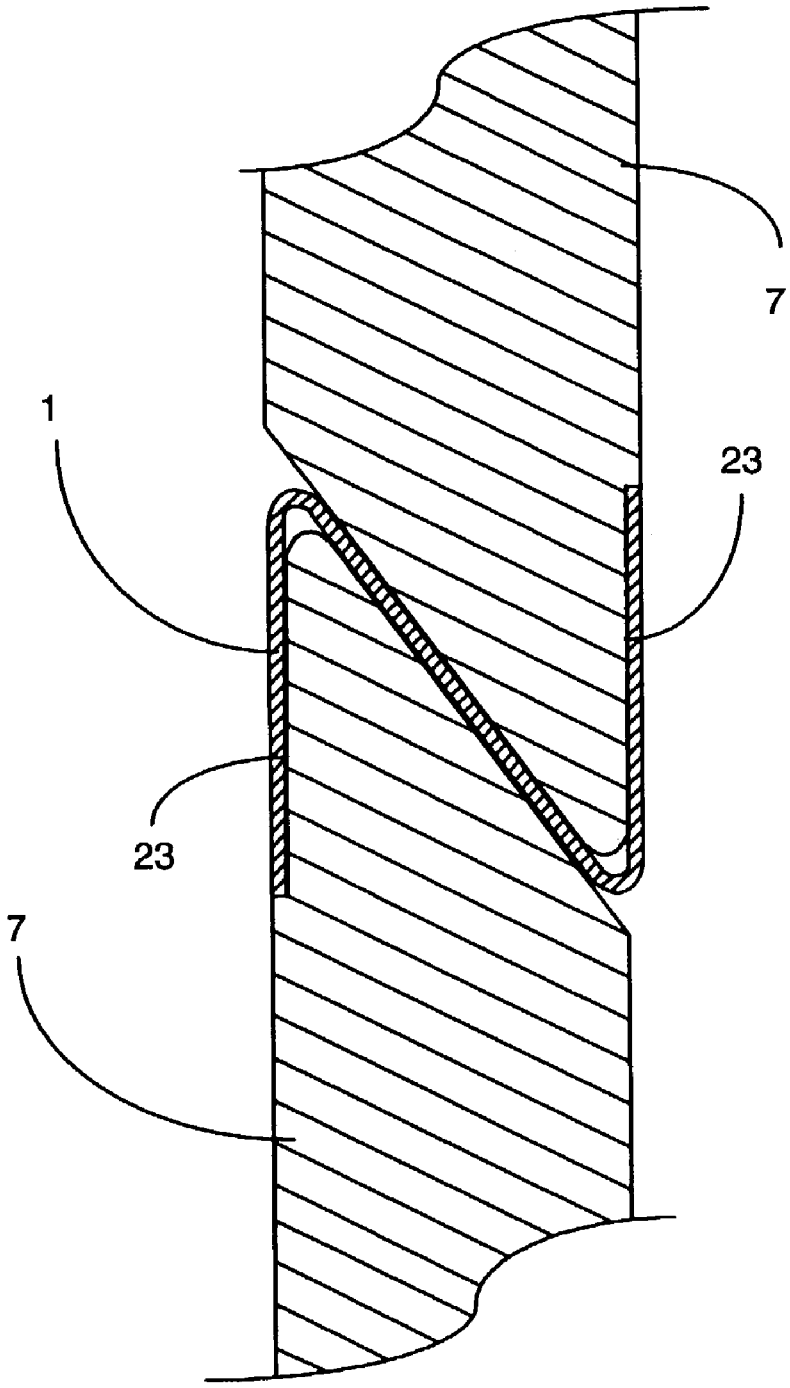
FIG. 4B is a top view of an alternative preferred embodiment of the Z-shaped wall panel connection device securing two adjacent foam wall panels together. This embodiment includes a recessed ledge to accommodate the thickness of the Z-shaped wall panel connection device.

In FIG. 4B, an alternative preferred embodiment is disclosed. In this embodiment, the foam wall panel 7 has a recessed ledge 23 which is sized such that the Z-shaped stud 1 will fit within the recessed ledge 23 such that the resulting wall will not have any protrusions caused by the thickness of the Z-shaped stud 1 when it is attached to a foam wall panel 7.

Figure 5:
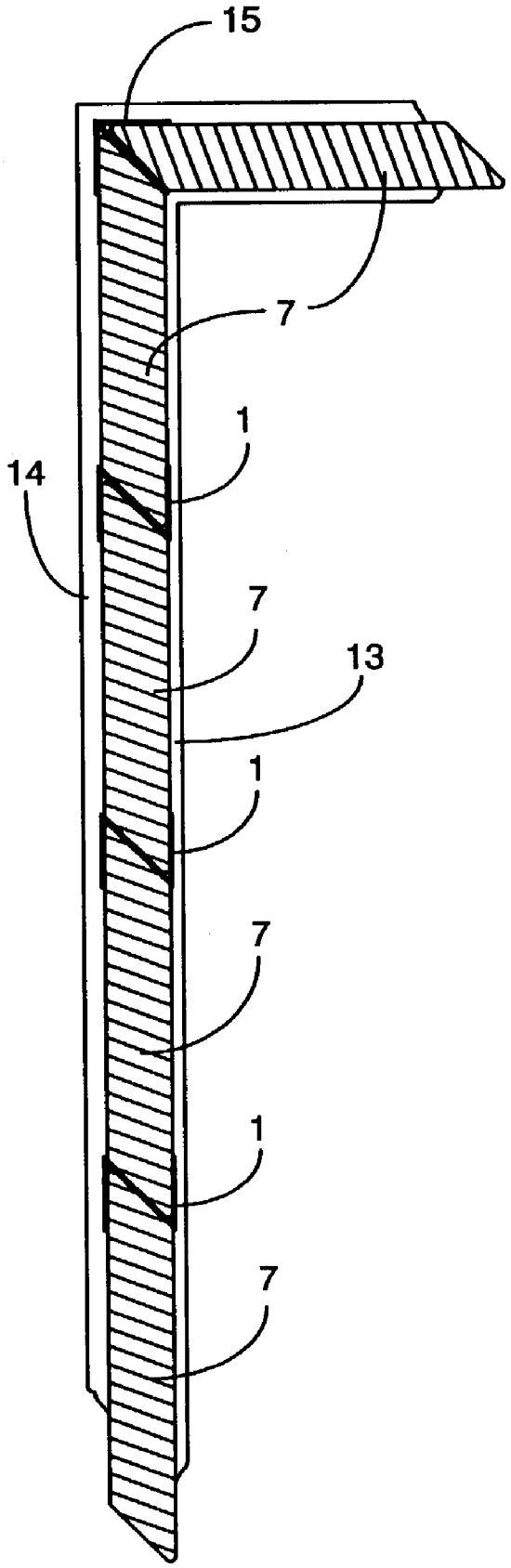
FIG. 5 is a top view of a preferred embodiment of a foam wall fabricated from a plurality of Z-shaped wall panel connection devices and foam wall panels. External sheathing is attached to one side of the foam wall, and internal sheathing (e.g., drywall) is attached to the other side of the foam wall.

FIG. 5 illustrates a segment of wall fabricated from a preferred embodiment of the invention. This embodiment illustrates how the foam wall panel system disclosed therein can be used to fabricate an exterior wall of a building. In this figure, multiple foam wall panels 7 are secured together by multiple Z-shaped studs 1 to form a long continuous wall. In addition to the Z-shaped studs 1, a special corner stud 15 is used to join two adjacent segments of foam wall panels 7 which are attached at right angles to one another. Also shown in this figure are exterior OSB sheathing 14 which is used to form the base of the exterior wall. Once formed, any suitable covering may be applied to the surface of the OSB sheathing 14, such as stucco, etc. to complete the exterior wall. Those skilled in the art will recognize that in addition to OSB sheathing 14, any suitable external wall surface material, such as plywood, bricks, etc. may be used to complete the outside surface of the wall. The interior side of the wall includes conventional drywall 13 which has been secured to the surface of the foam wall panels 7. As was the case with the exterior walls, those skilled in the art will recognize that the interior walls can also be covered with any suitable conventional surface material. In addition to drywall, decorative stone, brick wood paneling, etc. may also be used to complete the interior wall.

As can be seen from this figure, the foam wall panels 7 provide a continuous and complete layer of insulating material which insulates a variety of environmental factors, such as temperature, sound, etc. This figure also illustrates an advantage of the foam wall system provided herein in that the Z-shaped studs 1 also replace conventional metal wall studs. As a result the Z-shaped studs 1 performs two functions, and performs those functions with a structure that is less expensive to manufacture and simpler and easier to install than conventional metal wall studs.

Figure 6:
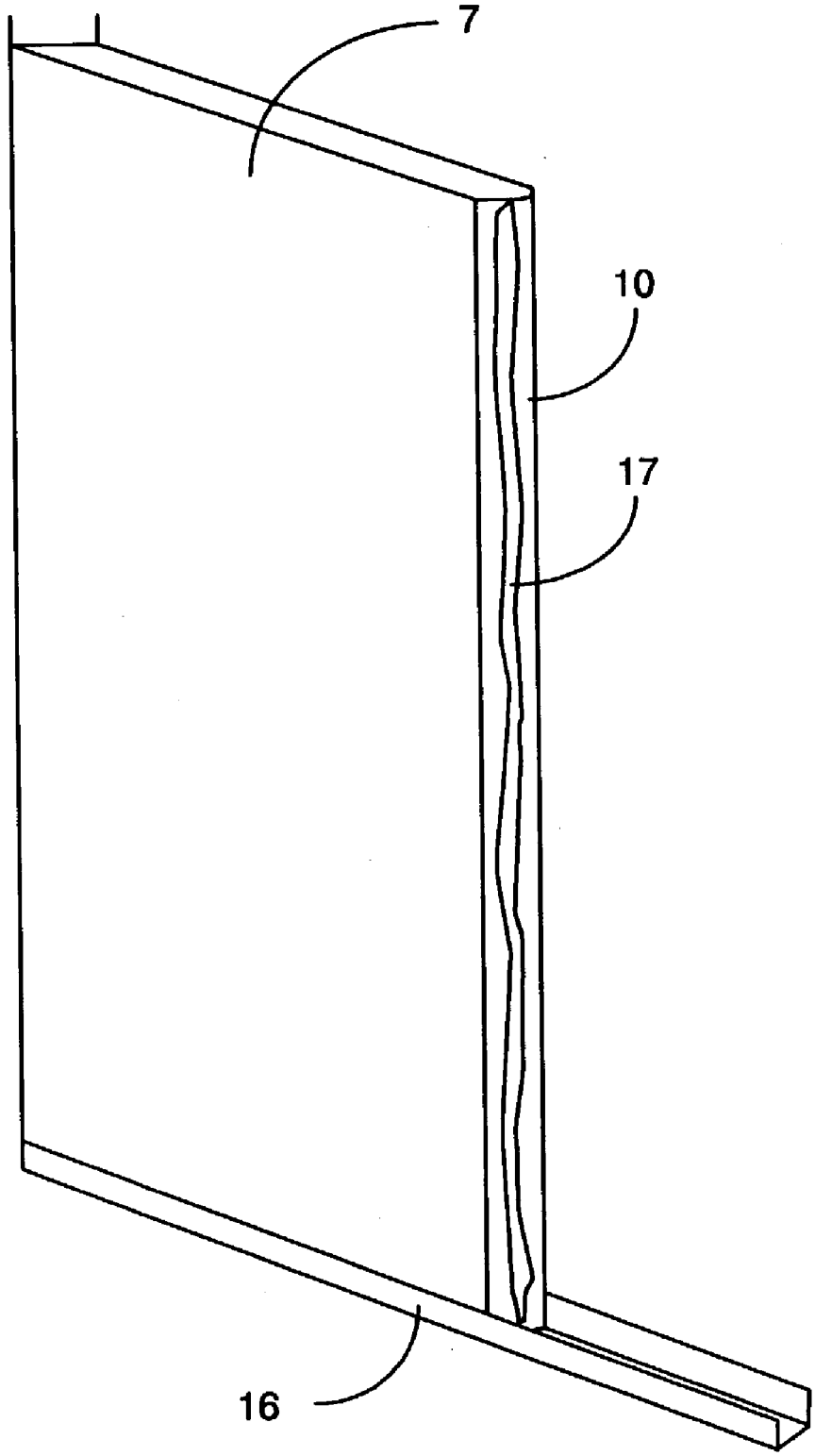
FIG. 6 is a perspective view of a preferred embodiment a foam wall panel inserted into a floor support guide. An optional bead of adhesive is also shown on the side edge of the foam wall panel.

FIG. 6 illustrates a preferred embodiment of the invention which uses a conventional channel guide 16 to define the location and orientation of a wall on a floor. Channel guides 16 are well known in the art and provide an easy method to layout and position where walls will be installed on a building is under construction. Typically, the channel guides 16 are installed and then the walls are built by installing studs at various points along the channel guides 16. Once the studs are installed, wall surfaces such as drywall can be installed to complete the wall structure. Optionally, insulation can be installed on the inside of the wall structure for the purposes discussed above.

In this embodiment, the foam wall panel 7 is first installed into the channel guide 16 to define its desired position within the room. After the foam wall panel 7 is installed into the channel guide 16, an optional bead 17 of adhesive, or sealant can be applied to the side edge 10 of foam wall panel 7. The bead 17 will adhere the foam wall panel 7 to the Z-shaped stud 1 when it is installed. In addition, the bead 17 also form an airtight seal to improve the insulation quality of the resulting foam wall.

While the bead 17 can be used as adhesive to secure the side edge 10 of the foam wall panel 7 to the connecting wall 4 of the Z-shaped stud 1, it does not have to be an adhesive and it does not have to be used merely to secure the components together. In the situation where insulation and drafts are a concern, the bead 17 can be merely a sealant which is designed to prevent air flow between adjacent foam wall panels 7.

For ease of discussion, the use of an applied adhesive bead 17 is discussed as a method of attaching the Z-shaped stud 1 to the foam wall panel 7. However, those skilled in the art will recognize that the adhesive bead 17 can easily be pre-applied to either the Z-shaped stud 1 or to the foam wall panel 7 at the point of manufacture, and temporarily protected by a pull-away sheet of paper. In this manner, the adhesive would be protected until the Z-shaped stud 1 was ready to be attached to the foam wall panel 7. For example, just prior to insulation, the workman would remove the pull-away sheet of paper to expose a layer of adhesive on the central wall 4 of the Z-shaped stud 1, and then mount the Z-shaped stud 1 on the foam wall panel 7. This eliminates the need for the workman to supply adhesive and to go through the inconvenience of applying it. As a result, the bead can be discrete adhesive applied by workman, or can be a pre-applied layer of adhesive which is protected by the paper cover until installation.

Figure 7:
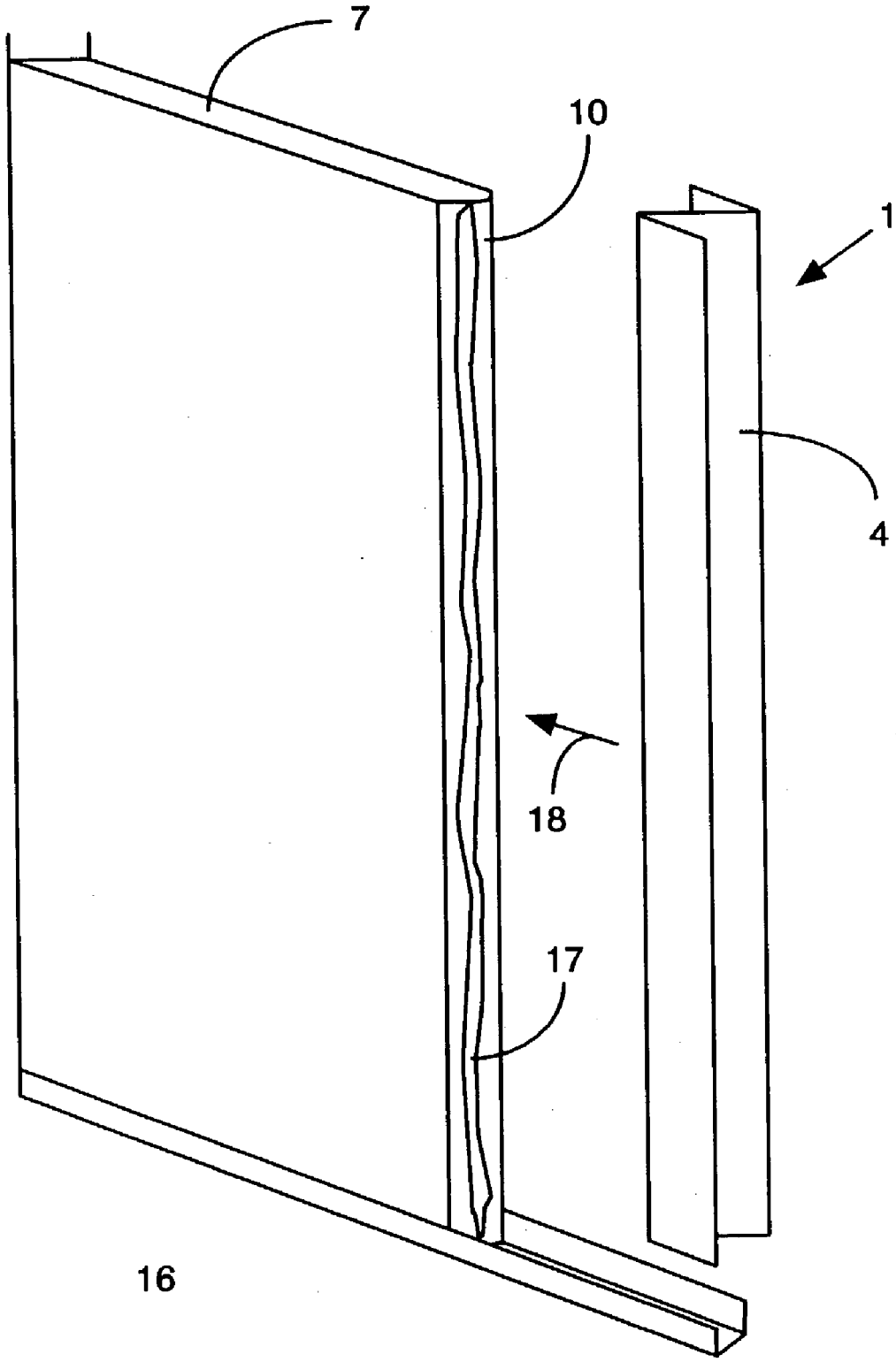
FIG. 7 is a perspective view of a preferred embodiment a foam wall panel inserted into a floor support guide, and a Z-shaped wall panel connection device being installed on the edge of the foam wall panel.

FIG. 7 illustrates a preferred embodiment of the Z-shaped stud 1 being inserted longitudinally, along line 18, onto foam wall panel 7. Once installed the bead 17 on side edge 10 will be pressed against connecting wall 4 to form a tight seal.

Figure 8:
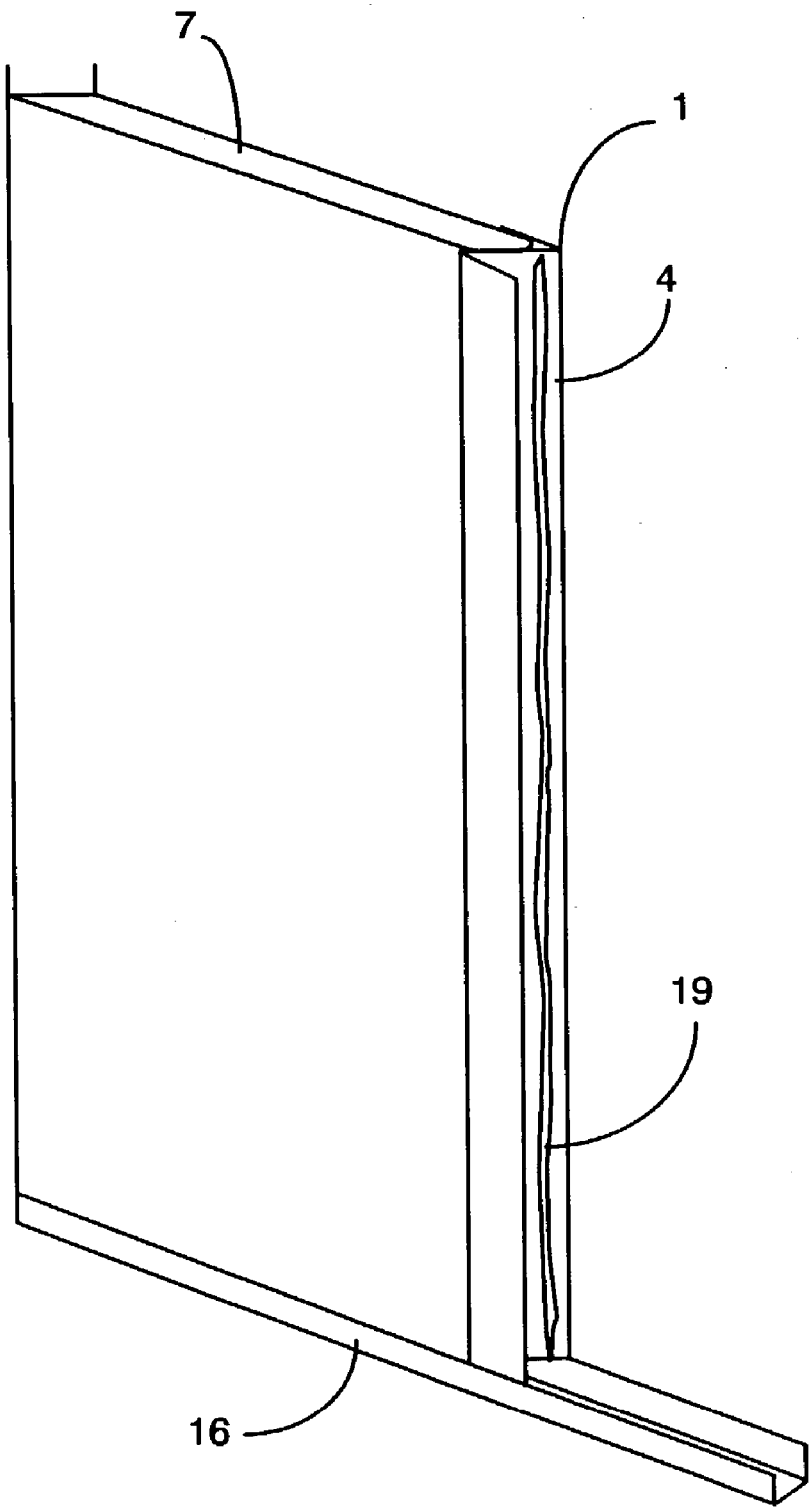
FIG. 8 is a perspective view of a preferred embodiment a foam wall panel inserted into a floor support guide, and a Z-shaped wall panel connection device installed on the edge of the foam panel. An optional bead of adhesive is also shown on the side edge of the Z-shaped wall panel connection device

FIG. 8 illustrates the next step in the process of installing a wall using another optional bead 19 which is applied to the other side of the connecting wall 4 of the Z-shaped stud 1. Once the Z-shaped stud 1 is attached to the foam wall panel 7, optional bead 19 is then applied to the connecting wall 4 of the Z-shaped stud 1. After the bead 19 is applied, the second foam wall panel 7 (not shown) is installed onto Z-shaped stud 1.

Figure 9:
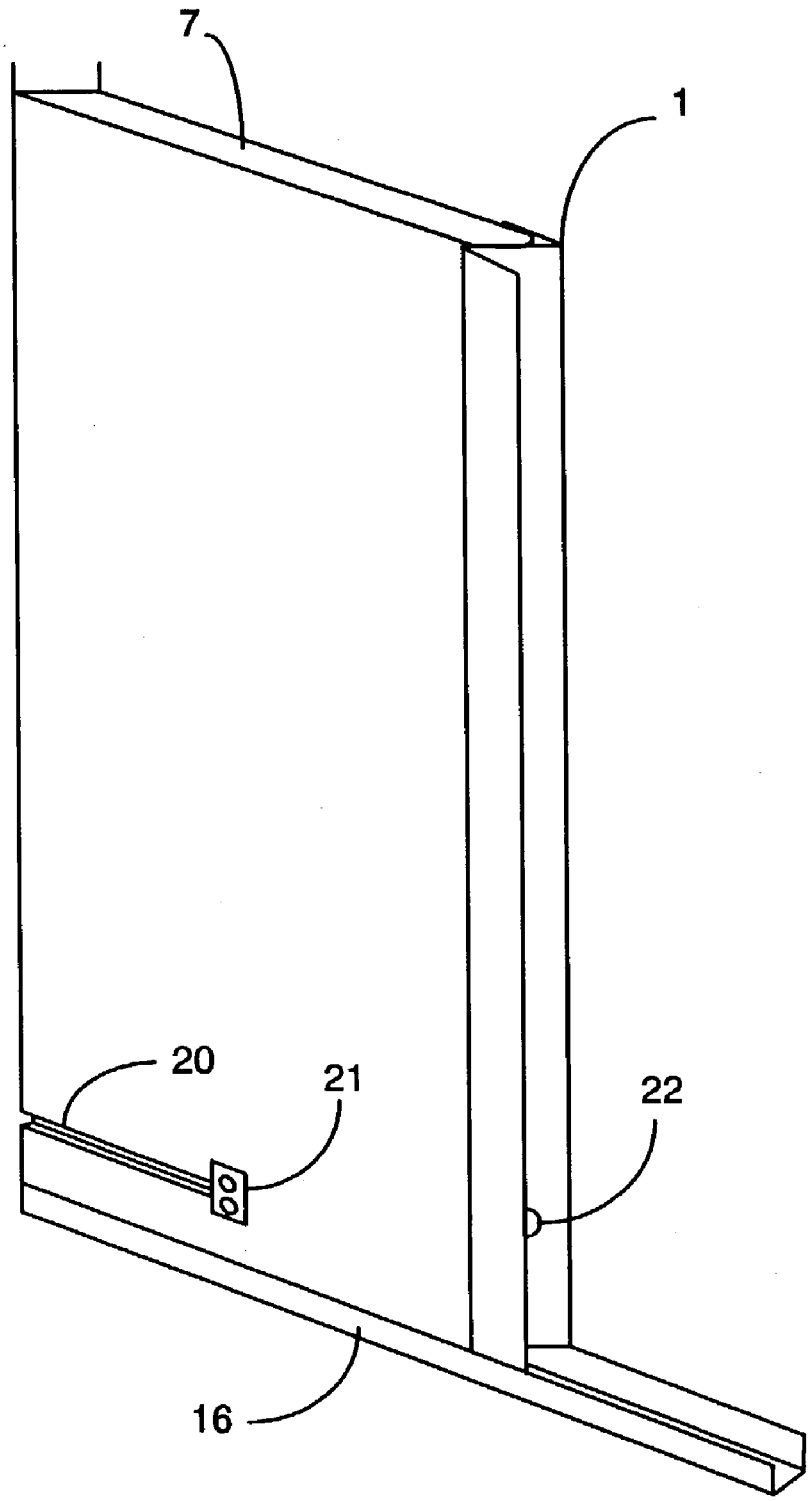
FIG. 9 is a perspective view of a preferred embodiment of the foam wall panel having a wire channel cut into the surface of the foam panel and an associated electrical output.

In FIG. 9, another preferred embodiment of the invention shown. In this embodiment the foam wall system includes the ability to run wiring (e.g. power lines, stereo speaker lines, computer system cabling, etc.) through the foam panel wall. Those skilled in the art will recognize that channels can be cut in foam paneling using known hot knife techniques. Once a foam panel wall is installed, a technician can easily cut a wiring channel 20 in the foam wall panel 7 to accommodate wiring or cabling of any type. As illustrated in this figure, the technician can determine where an outlet 21 is to be located and then cut the channel 20 directly to that location on the foam wall panel 7.

Also shown in this figure is cable aperture 22 which is located in Z-shaped stud 1. Cable aperture 22 is provided to address the situation where wiring is to the run through several foam wall panels 7 which are secured together by Z-shaped studs 1. As would be expected, cutting apertures in the Z-shaped studs 1 may be inconvenient and take special tools and skill, especially where the Z-shaped studs 1 are fabricated from metal, and/or potentially brittle materials such as plastics, etc. As a matter of convenience, the preferred embodiment envisions the use of a cable aperture 22 which the technician can use to pass cabling through. Those skilled in the art will recognize that depending on how many sets of cables are run, more than one cable aperture may be desired, and may be used.

Figure 10:
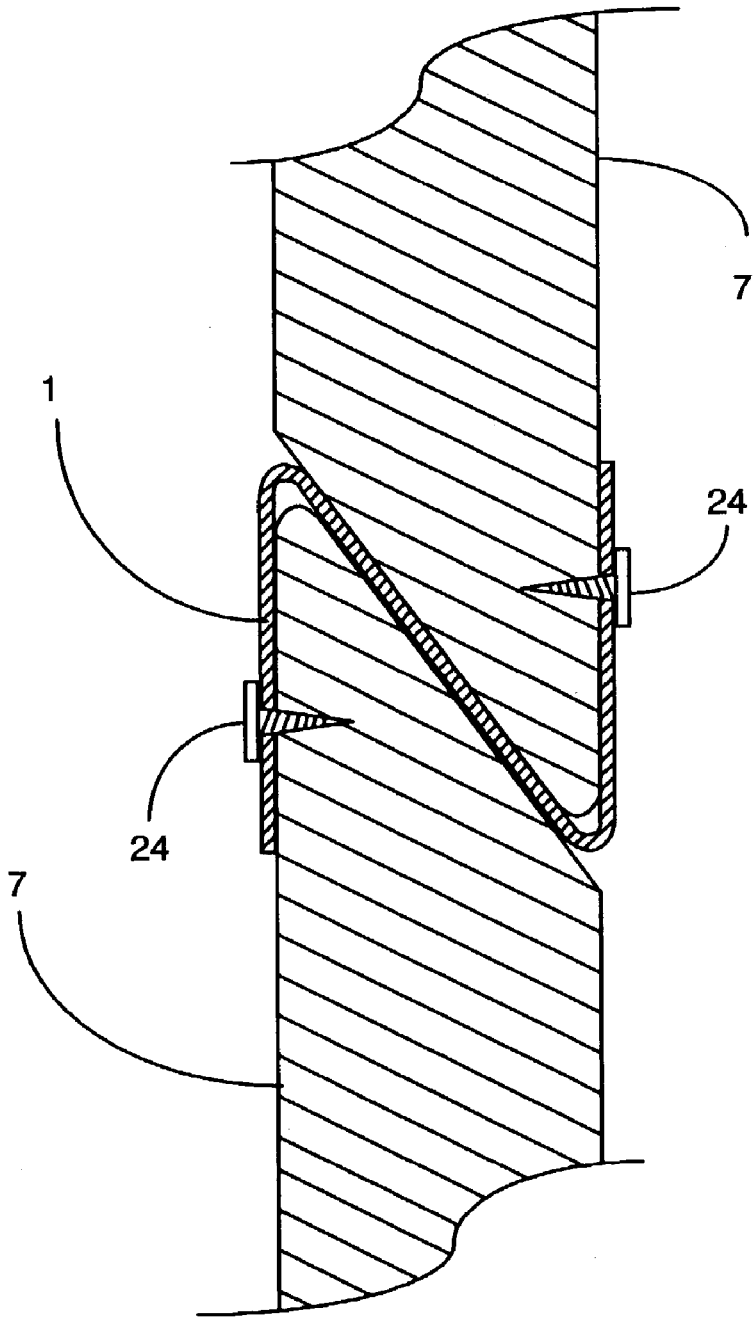
FIG. 10 is another alternative embodiment which illustrates the Z-shaped stud secured to adjacent foam wall panels via nails.

FIG. 10 illustrates another alternative preferred embodiment. The foregoing embodiments have been discussed in terms of adjacent foam wall panels 7 which are secured to a Z-shaped stud 1 by pressure fit, or by adhesive. In this embodiment, the Z-shaped stud 1 a shown secured to 2 adjacent foam wall panels 7 via nails 24. Of course, the function of nails 24 can be accomplished by nails, screws, tacks, staples, rivets, etc. The only requirement is that they provide a suitable positive attachment of the Z-shaped stud 1 to a foam wall panel 7. Further, the nails 24 can be secured to any portion of the Z-shaped stud 1, including the connecting wall 4. Of course, the preferred embodiment envisions that any securing device, such as nails 24, the counter sunk to provide a flat wall surface for finishing.

While the invention has been described with respect to a preferred embodiment thereof, it will be understood by those skilled in the art that various changes in detail may be made therein without departing from the spirit, scope, and teaching of the invention. For example, the material used to construct the Z-shape stud may be anything suitable for its purpose, the size and shape of the wall panels can vary, etc. The type of optional adhesives used to secure the components together can vary. The type of foam can also vary Accordingly, the invention herein disclosed is to be limited only as specified in the following claims.

I claim:

1. A foam panel connector system for securing adjacent foam panels, comprising:

a Z-shaped stud for securing and aligning adjoining foam panels, further comprising a first side wall having a first edge and a second edge;

a second side wall having a first edge and a second edge, the second side wall substantially parallel to the first side wall;

a connecting wall having a first edge and a second edge;

the first and second side walls are substantially planar from the first edge to the second edge, having no end lip to enable smooth lateral insertion of foam panels;

the first edge of the connecting wall attached to an edge of the first side wall at a non-perpendicular angle, and the second edge of the connecting wall attached to an edge of the second side wall attached such that the connecting wall extends from the first side wall to the second side wall at a non-perpendicular angle;

the angle at which the connecting wall is attached to the first side wall defining a first cavity between the connecting wall and the first side wall, and the angle at which the connecting wall is attached to the second side wall defining a second cavity between the connecting wall and the second side wall;

the first and second cavities located on opposite sides of the connecting wall such that two adjacent foam panels, each foam panel having at least one edge suitable for insertion into the first or second cavities, can be connected together by inserting the edges of the foam panels into the first and second cavities, the first and second cavities aligned with one another and overlapping, the first cavity configured to receive a first foam panel with an angled edge configured to snugly fit within the first cavity, the second cavity configured to receive a second foam panel with an angled edge configured to snugly fit within the second cavity such that their edges overlap one another;

the first side wall having an attachment point to the connecting wall that is rounded;

the second side wall having an attachment point to the connecting wall that is rounded such that when the Z-shaped stud secures foam panels with angled edges together, the edges to the foam panels overlap one another;

a foam wall panel having a first side, a second side, and a side edge; and the side edge of the foam wall panel extending from the first side to the second side at an angle such that it substantially conforms to the first or second cavity in the Z-shaped stud.

2. A system, as in claim 1, wherein the Z-shaped stud is fabricated from a single sheet of material.

3. A system, as in claim 1, wherein the foam wall panel has a rounded forward edge.

4. A system, as in claim 1, wherein the foam wall panel is fabricated from material that can be cut with a hot knife to form channels.

5. A system, as in claim 4, wherein the Z-shaped stud further comprises at least one cable aperture in the connecting wall.

6. A system, as in claim 1, further comprising:

means to seal a first side of the connecting wall of the Z-shaped stud to the foam wall; and means to seal the second side of the connecting wall Z-shaped stud to a second adjacent foam wall.

7. A system, as in claim 6, wherein the means to seal the first side and the second side of the connecting wall is an adhesive.

8. A system, as in claim 1, wherein the Z-shaped stud is secured to the foam wall panel via nails, screws, rivets, or staples.

9. A system, as in claim 1, wherein the foam wall panel has a recessed panel sized such that the side wall of the Z-shaped stud, when mounted on the foam wall panel, is substantially even with a surface of the foam wall panel.

* * * * *